US005566514A

United States Patent [19]

Freller

[11] Patent Number: 5,566,514

[45] Date of Patent: Oct. 22, 1996

[54] SELF-SUPPORTING BUILDING STRUCTURE

[76] Inventor: Walter Freller, A-5310 Mondsee, Postfach 2, Innerschwand 226, Austria

[21] Appl. No.: 397,902

[22] Filed: Mar. 3, 1995

[51] Int. Cl.[6] ..... E04H 1/12

[52] U.S. Cl. ..... 52/79.5; 52/71; 52/79.4; 52/79.8; 135/100; D25/23

[58] Field of Search ..... 52/79.1, 79.4, 52/79.5, 79.7, 79.8, 71, 64, 91.1; 135/95, 100, 143; 229/116, 116.4; 446/110, 112; D21/253; D25/1, 16, 17, 22, 26, 29, 30, 32, 33, 23

[56] References Cited

U.S. PATENT DOCUMENTS

| | | | |
|---|---|---|---|
| D. 263,255 | 3/1982 | Zima . | |
| D. 275,889 | 10/1984 | Nelson . | |
| 1,599,213 | 9/1926 | Coupal | 135/100 |
| 2,071,093 | 2/1937 | Van Horn . | |
| 3,230,673 | 1/1966 | Gersin . | |
| 3,346,998 | 10/1967 | Nelson . | |
| 3,714,749 | 2/1973 | Aitken | D25/26 X |
| 3,759,277 | 9/1973 | Glade . | |
| 3,983,665 | 10/1976 | Burton . | |
| 4,064,662 | 12/1977 | O'Toole . | |
| 4,073,105 | 8/1974 | Daugherty | 446/110 X |
| 4,285,174 | 8/1981 | Knight . | |
| 4,413,452 | 11/1983 | Wilkinson . | |
| 4,672,779 | 6/1987 | Boyd . | |
| 4,726,155 | 2/1988 | Nahmias . | |
| 4,937,987 | 7/1990 | Runyon . | |
| 4,951,432 | 8/1990 | Wilkinson . | |

FOREIGN PATENT DOCUMENTS

| | | | |
|---|---|---|---|
| 2225358 | 5/1990 | United Kingdom | 52/79.1 |

*Primary Examiner*—Carl D. Friedman
*Assistant Examiner*—Timothy Kang
*Attorney, Agent, or Firm*—Quarles & Brady

[57] ABSTRACT

A generally pyramidal structure is formed by a plurality of sloping sides with adjacent sides abutting along a ridge joint which intersects a common vertex. The pyramid is truncated, thereby creating an opening transverse to one ridge joint and extending through the two adjacent sloping sides. The opening typically is closed by a vertical structural element. This pyramidal building design can be applied to structures of different sizes from small collapsible shelters, as substitutes for tents, to permanent buildings having multiple stories and/or adjoined units. The basic embodiment of this design has four oblique quadrilateral panels which form triangular openings along opposite ridges.

18 Claims, 4 Drawing Sheets

FIG. 1
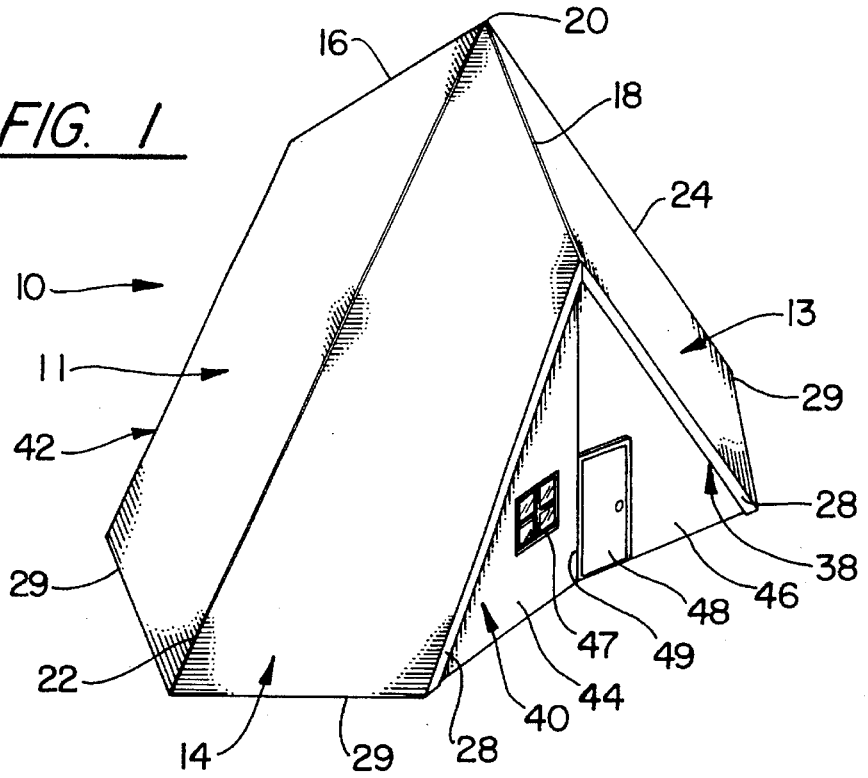
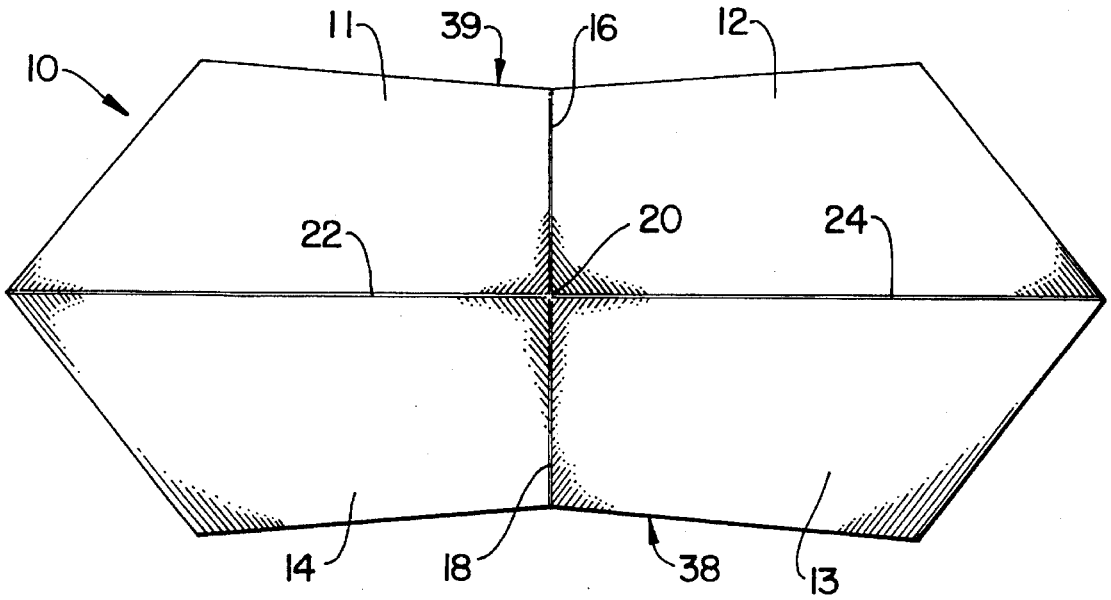
FIG. 2

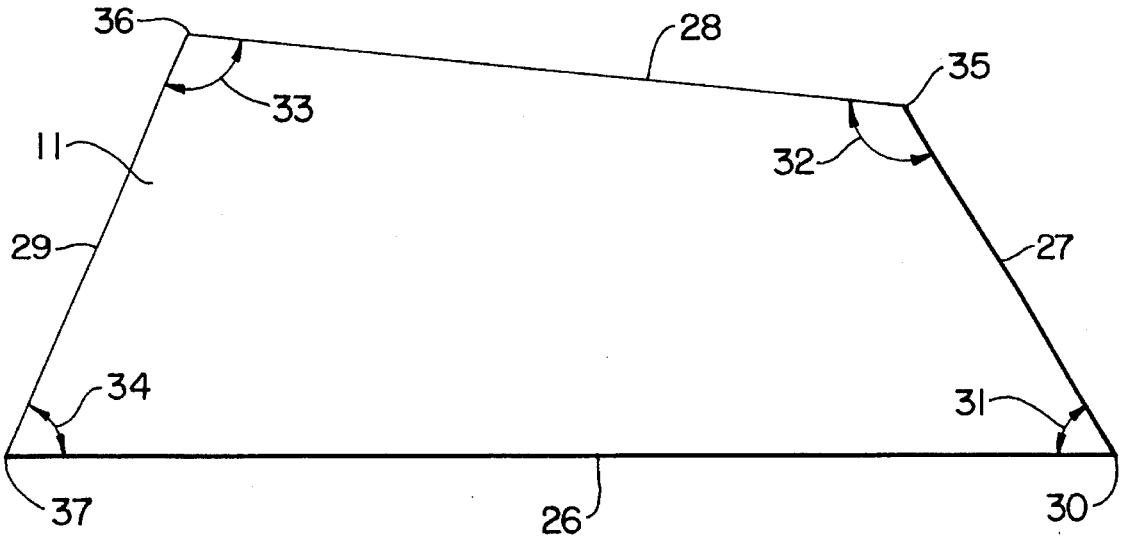
FIG. 3
FIG. 4
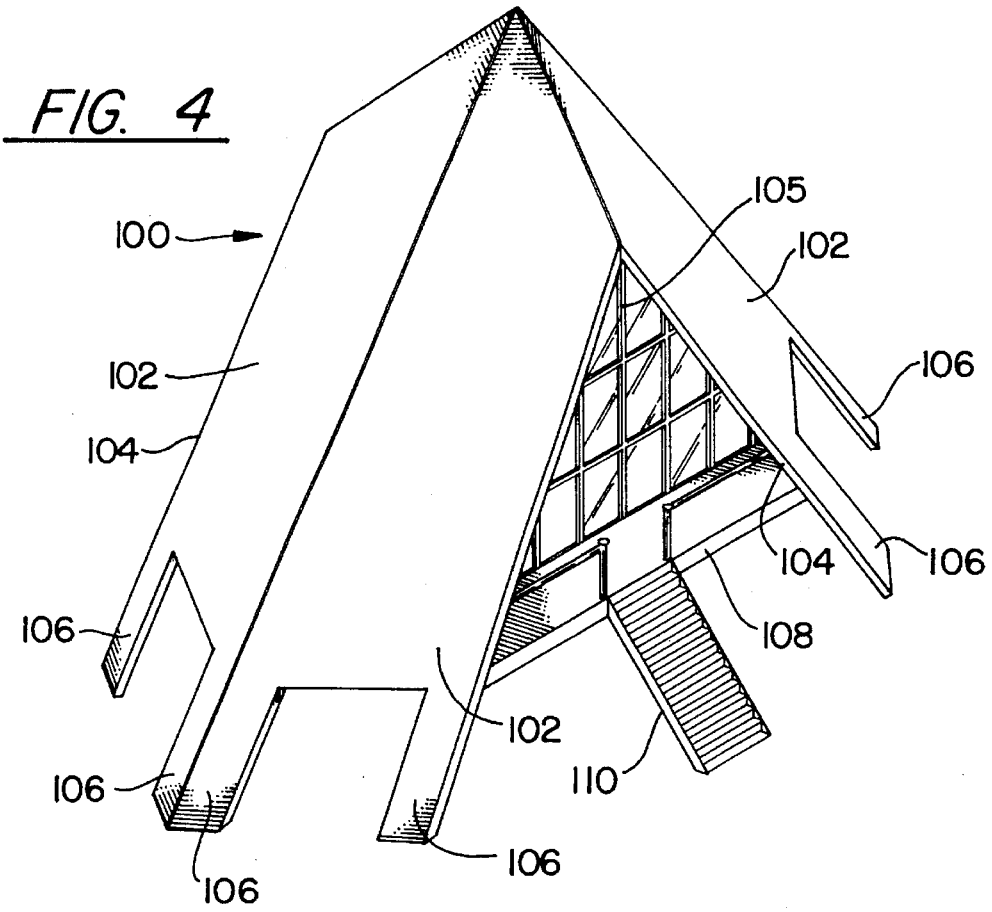

SELF-SUPPORTING BUILDING STRUCTURE

BACKGROUND OF THE INVENTION

The present invention relates to the structure of buildings; and more particularly to buildings having a pyramidal shape.

Since the beginning of time, housing and general shelter construction has been of great importance. Many societies have continuously attempted to develop low cost, easily constructed buildings capable of a variety of uses including residences, storage and like applications. The obvious use of a building is to provide shelter against the atmospheric elements. In many locations climatic conditions produce storms with high velocity winds which require that buildings constructed there be able to withstand the forces generated by such winds.

It is also desirable to be able to construct building structures formed of a plurality of prefabricated panels. These panels can be produced in factories under controlled conditions and quality standards. Mass production techniques also reduce the cost of prefabricated panels. The costs can be reduced further when the panels have common shapes with the number of different shapes being kept to a minimum.

There is also a need for temporary shelters which can be stored in a collapsed state and quickly assembled when a need arises. For example, these temporary shelters find use in the aftermath of disasters to provide housing for victims displaced from their homes. In addition, collapsible shelters can be utilized by military personnel and others when traveling.

While pyramids can provide structural and other benefits, the construction is not collapsible. Moreover, windows, doors and other openings are difficult to introduce to the slanted walls. Also, pyramids are not readily modular for combination to create larger structures.

SUMMARY OF THE INVENTION

The general object of the present invention is to provide a sturdy building structure.

Another object is to provide a building structure that is fabricated from panels of similar shape and size which facilitate prefabrication and erection.

A further object is to provide a structure in which the interconnected panels become self supporting without the need for internal members.

A still further object is to provide self supporting structures that can be adjoined as modular units to construct larger buildings in a variety of floor plan arrangements.

Yet another object of the present invention is to provide a shelter that can be collapsed for storage and transport.

These objects are fulfilled by a building having a plurality of sloping, rigid panels adjoining one another in the general form of a pyramid. Adjacent sides are joined along a separate ridge seam that extends downward from a common vertex and at least two adjacent sloping panels are truncated transversely to the ridge seam therebetween to form a vertical opening. Other pairs of adjacent panels can be truncated similarly to provide additional openings to the building.

The basic embodiment of this structural concept has four oblique quadrilateral rigid panels joined together with all the panels meeting at a common vertex. The quadrilateral shape of the panels form triangular openings at the bottoms of two opposite ridges. In large scale embodiments, these openings are closed by structural elements that include windows and a door.

The building structure of the invention can be utilized as a modular unit that can be interconnected to other units in straight or staggered fashion to construct larger buildings. The different arrangements can provide a variety of floor plan possibilities. Significantly, each modular unit enjoys its own structural stability and contributes to the overall strength of the larger structure.

This pyramidal building design can also be applied to temporary shelters, as substitutes for tents commonly used in diaster relief for example. In this version, the panels can be joined by hinges along the ridge enabling the structure to collapse into a flat form for storage and transport. The triangular openings of the shelter can be closed by flexible material, such as canvas or plastic, because the panels provide a self-supporting shell.

BRIEF DESCRIPTION OF THE DRAWINGS

FIG. 1 is an isometric view of a building according to the present inventions;

FIG. 2 is top view of the building;

FIG. 3 is a plane view of a panel which forms part of the building;

FIG. 4 is an isometric view of another embodiment of building having a floor that is elevated above the ground;

DETAILED DESCRIPTION OF THE INVENTION

Figure 5:
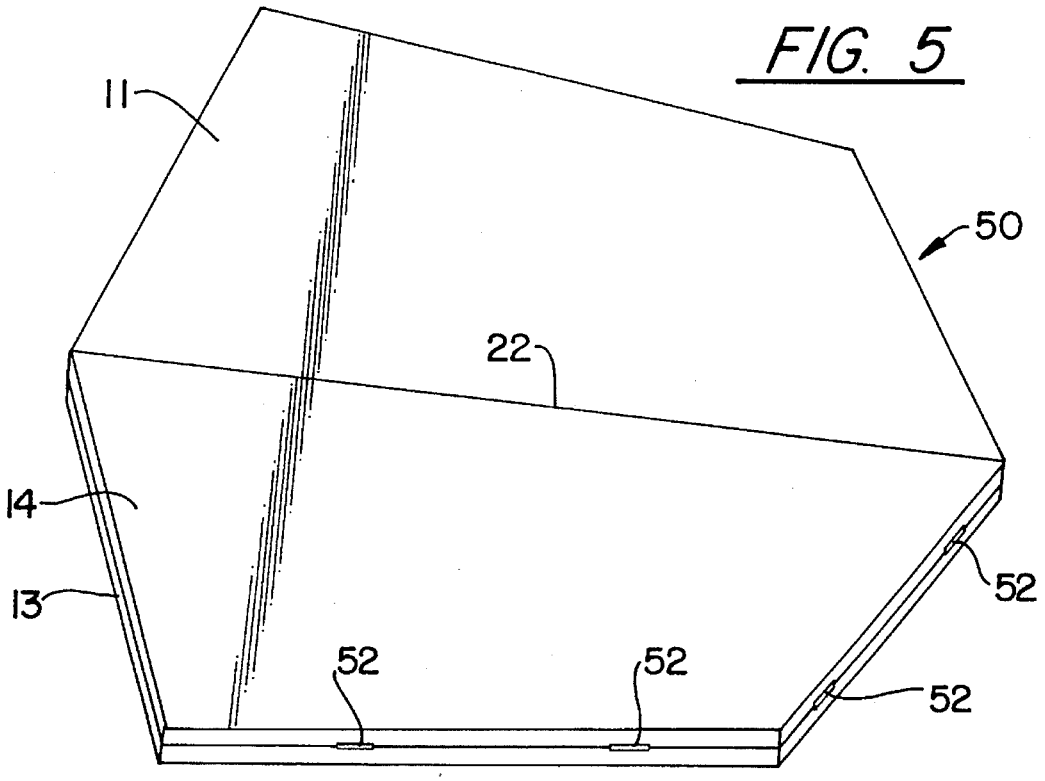
FIG. 5 is a plane view of a smaller, transportable embodiment of he building structure in a collapsed state.

With initial reference to FIGS. 1 and 2, a building 10 is a permanent structure having multiple stories with an interior subdivided by walls and floors. The generally four-sided pyramidal structure of the illustrated building 10 is formed by four rigid panels 11, 12, 13 and 14, although different numbers of panels may be provided. In the assembled building, the panels 11–14 create a slanted roof that extends from the ground upward to two roof ridges 16 or 18 which meet at a common vertex 20. The building 10 has one half formed by the first and fourth panels 11 and 14, which join at a side ridge 22 extending between the ground and vertex 20. The other half of the building comprises the second and third panels 12 and 13 which are joined along another side ridge 24 that extends from the ground to the vertex 20.

The four rigid panels 11–14 have similar oblique shapes. In particular, the first and third panels 11 and 13 are identical, and the second and fourth panels 12 and 14 are mirror images of the first and third panels as evidenced in FIG. 2. With this similarity understood, the structure of the panels will be described with respect to the first panel 11 shown in detail in FIG. 3. The first panel 11 has four edges 26, 27, 28 and 29 forming a preferably oblique panel wherein none of the edges is either perpendicular or parallel to any of the other edges. Other quadrilateral panels, such as trapezoidal panels, may be used within the broad concept of the present structural design. For the preferred panel, the first and second edges 26 and 27 meet at a first corner 30 and extend from one another at an acute angle 31. The second and third edges 27 and 28 come together at a second corner 35 at an obtuse angle 32. The third and fourth edges 28 and 29 of the first panel 11 join at an obtuse angle 33 at the third corner 36. Finally, the fourth edge 29 meets the first edge 26 at the fourth corner 37 with an acute angle 34 therebetween. The first and third edges 26 and 28 are opposed to one another on opposite edges of the first panel 11 with the first edge 26 being longer than the third edge 28. The second and fourth edges 27 and 29 also are opposed to each other on opposite edges of the first panel 11 with the fourth edge 29 being slightly longer than the second edge 27 in the preferred embodiment.

When the four panels 11–14 are joined together to form the structure of building 10, the first edges 26 of the first and fourth panels 11 and 14 are joined together to form side ridge 22. Similarly, the first edges 26 of the second and third panels 11 and 13 come together at the other side ridge 24. The second edges 27 of the first and second panels 11 and 12 are connected at one roof ridge 16, and the joining of the second edges 27 of the third and fourth panels 13 and 14 forms the other roof ridge 18. In the assembled structure, the fourth edge 29 of each panel 11–14 rests on the ground. The assembly of panels 11–14 is symmetrical about a first vertical plane that contains the two roof ridges 16 and 18 and also is symmetrical about a second vertical plane that contains the two side ridges 22 and 24 as is apparent in FIG. 2. The panels assembled in this manner are self supporting in that internal support members are not required. Although internal walls may be provided to subdivide the interior space into rooms, such internal walls are non-load bearing with respect to the exterior panels.

Referring to FIGS. 1 and 2, the third edges 28 of the four panels 11–14 create a pair of triangular openings 38 and 39 on opposite sides of the building 10. The present structural concept may be implemented with only one opening or more than two openings by truncating the ridges 16, 18, 22 and 24 at what otherwise would be bottom corners of a pyramidal structure. Each opening 38 and 39 is closed by a structural element 40 and 42, respectively. Although only structural element 40 is visible in FIG. 1, the structural element 42 closing the other triangular opening 39 is similar to the illustrated element 40 because of the symmetry of the building about side ridges 22 and 24. Structural element 40 comprises a pair of triangular walls 44 and 46 which bow inward slightly at central vertical joint 49 and each triangular wall 44 and 46 has a hypotenuse which extends along the third edge 28 of an adjoining panel 13 or 14. The adjacent panels 13 and 14 may extend outward from the triangular walls 44 and 46 providing an overhang. The first triangular wall 44 has a window 47 and the second triangular wall 46 has a door 48 for access to the interior of the building 10. Alternatively, one or both of the triangular walls 44 and 46 can be formed entirely of glass panels to provide window walls which allow natural light into the building 10.

FIG. 4 illustrates an embodiment in which pyramidal building 100 is raised above the ground as may be desirable on beach front property or in other areas prone to flooding. The structure of building 100 is similar to that of building 10 in FIG. 1 in that the latter building is formed by four quadrilateral panels 102 joined to form a pyramid with truncated corners that create openings 104 on opposite sides of the building. The openings are closed by structural elements 105 which comprise planar walls recessed from the adjacent edges of the truncated panels 102.

Each panel 102 has a pair of legs 106 contiguous therewith which raise the floor 108 of the building 100 above the ground and stairs 110 provide access to the elevated floor. Additional structural members (not shown) may be required to support the floor 108 from below. The spaced apart legs 106 create openings to the region beneath the building so that in flood prone geographical areas water is allowed to flow under the building. This raised version of the building concept also can be used to create storage space under the structure even in non-flood prone areas.

Although buildings 10 and 100 are permanent structures with several rooms on different floor elevations, the present building concept also can be utilized to provide a smaller, transportable shelter as an alternative to tents. In this transportable shelter 50, the four oblique quadrilateral rigid panels 11–14 are assembled in the same manner as the larger structure shown in FIGS. 1 and 2, but with flexible connectors 52, such as hinges, fastening adjacent panels as shown in FIG. 5. Such connection enables the shelter 50 to fold flat so that the first and fourth panels 11 and 14 lie in a common plane and the second and third panels 12 and 13 also lie in a common plane. In the collapsed state, the inner surfaces of the first and fourth panels 11 and 14 lie against inner surfaces of the second and third panels 12 and 13. Alternatively, the panels can be connected with removable fasteners that enable the panels to be separated for storage and transport. The rigid panels 11–14 of the collapsible structure can be fabricated of a lightweight material, such as a plastic foam, which has a sufficient degree of rigidity while providing a lightweight assembly that is easily transported. In the assembled state, the edges of adjacent panels interlock, for example by a tongue and groove mechanism, to provide a weather tight joint.

Figure 6:
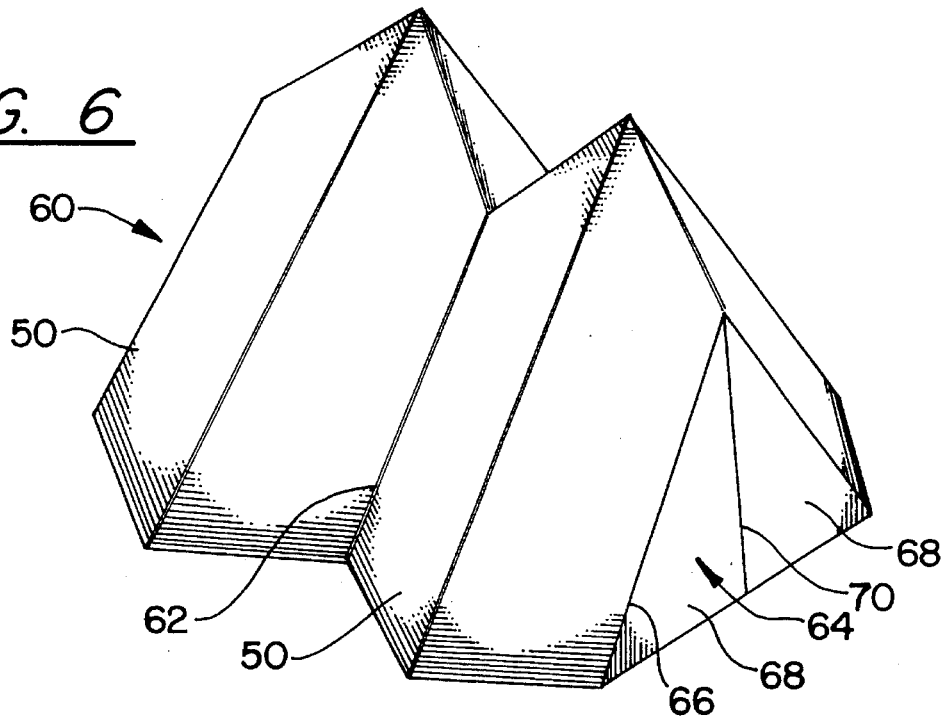
FIG. 6 illustrates two buildings attached to form a larger structure.
Figure 7:
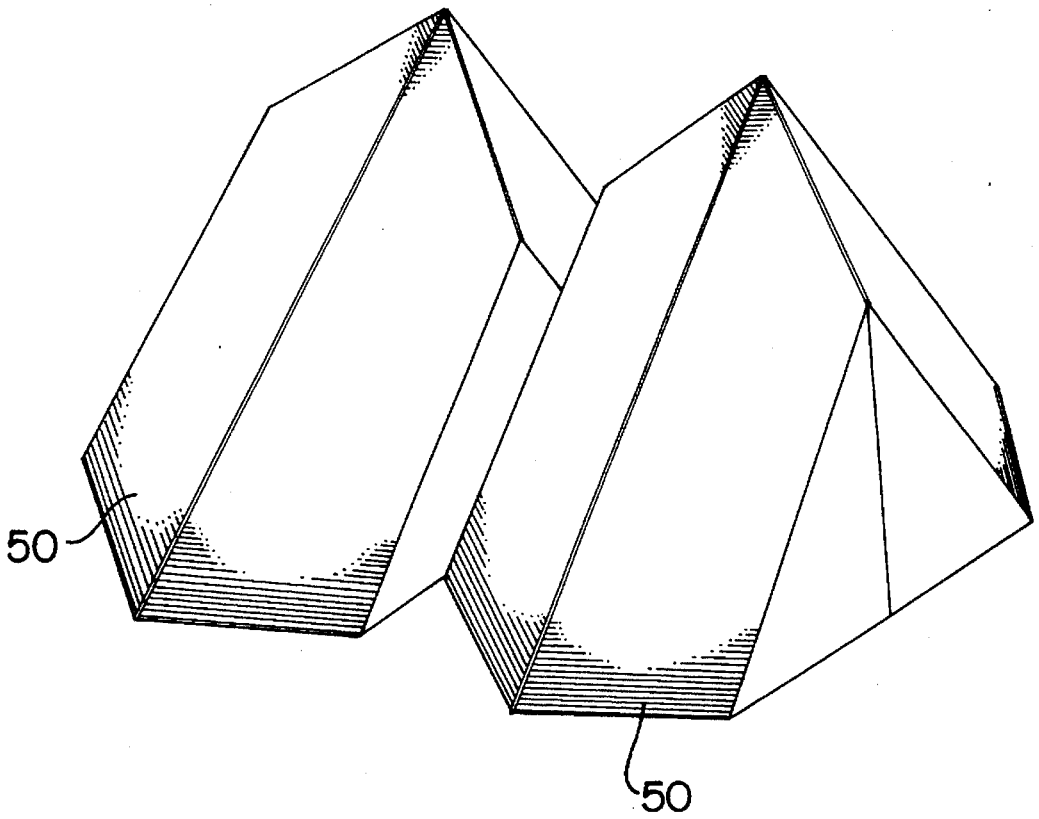
FIG. 7 illustrates an alternative embodiment of staggered units.
Figure 8:
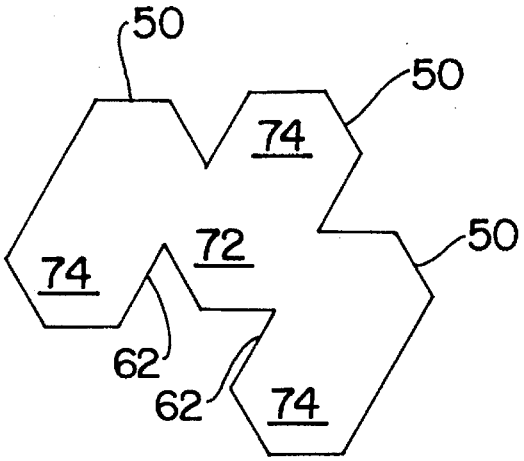
FIG. 8 snows a floor plan of an embodiment constructed from the staggered connection of three units according to the invention.

A larger structure 60 can be fabricated as shown in FIG. 6 by joining two or more pyramidal shelters 50 (or even permanent buildings 10) at their triangular openings 62 formed by the truncation of the bottom corners. In this combination, the joined openings 62 do not have to be closed by a structural element 64 as does the exposed opening 66. Referring to FIG. 7, two or more pyramidal shelter 50 can be adjoined in offset manner to provide a variety of interior space arrangements. For example, as illustrated in FIG. 8, a floor plan of three staggered structures 50 provides an elongated central area 72 with a plurality of shorter areas 74 to the sides. The staggered arrangement also increases the available space for windows and doors. The modularity of the units 50 can also contribute to facilitated construction.

Because the panel assembly of each transportable shelter 50 is self-supporting, the exterior structural element 64 can be formed by a pair of flexible sheets 68 which close the triangular opening 66. Such sheets 68 may be made of canvas or plastic, including a transparent plastic to allow sun light into the shelter. The two sheets 68 are fastened by a closure mechanism 70, such as a zipper, along the vertical seam to provide a passage for ingress and egress.

The foregoing description was primarily directed to preferred embodiments of the invention while some attention was given to various alternatives within the scope of the invention. It is anticipated that one skilled in the art will likely realize additional alternatives that are not now apparent from the disclosure of embodiments of the invention. Accordingly, the scope of the invention should be determined from the following claims and not limited by the above disclosure.

I claim:

1. A building structure comprising a plurality of sloping sides adjoining one another in the form of a pyramid with adjacent sloping sides joined along a ridge that extends downward from a vertex, said pyramid being truncated along at least one of said ridges below said vertex, thereby forming a first opening which extends through said ridge and two adjacent sloping sides joined at the one ridge, said building structure comprising first, second, third and fourth quadrilateral panels with each one having first, second, third and fourth edges in which the first and third edges oppose each other and the second and fourth edges oppose each other, wherein:

the second edge of the first quadrilateral panel abuts the second edge of the second quadrilateral panel;

the first edge of the second quadrilateral panel abuts the first edge of the third quadrilateral panel;

the second edge of the third quadrilateral panel abuts the second edge of the fourth quadrilateral panel; and the first edge of the fourth quadrilateral panel abuts the first edge of the first quadrilateral panel.

2. The building structure as recited in claim 1 wherein the first opening is closed by a substantially vertical wall.

3. The building structure as recited in claim 2 wherein said substantially vertical wall includes at least one of a window and a door.

4. The building structure as recited in claim 1 wherein the first opening is closed by a first wall joined to and extending substantially vertically from one of the two adjacent sides, and a second wall joined to and extending substantially vertically from another one of the two adjacent sides, wherein the first and second walls are non-coplanar.

5. The building structure as recited in claim 1 wherein the third edges of said first and second quadrilateral panels form edges of the first opening; and the third edges of said third and fourth quadrilateral panels form edges of a second opening.

6. The building structure as recited in claim 5 further comprising a first substantially vertical structural element closing the first opening, and a second substantially vertical structural element closing the second opening.

7. The building structure as recited in claim 6 wherein each of said first and second substantially vertical structural elements comprise a pair of non-coplanar walls.

8. A building structure comprising:

first, second, third and fourth quadrilateral panels with each one having first, second, third and fourth edges in which the first and third edges oppose each other and the second and fourth edges oppose each other; wherein:

the second edge of the first quadrilateral panel adjoins the second edge of the second quadrilateral panel;

the first edge of the second quadrilateral panel adjoins the first edge of the third quadrilateral panel;

the second edge of the third quadrilateral panel adjoins the second edge of the fourth quadrilateral panel; and the first edge of the fourth quadrilateral panel adjoins the first edge of the first quadrilateral panel.

9. The building structure as recited in claim 8 wherein each one of said first, second, third and fourth quadrilateral panels has the second edge extending from the first edge at an acute angle, the third edge extending from the second edge at an obtuse angle, the fourth edge extending from the third edge at an obtuse angle, the fourth edge extending from the first edge at an acute angle.

10. The building structure as recited in claim 8 wherein each one of said first, second, third and fourth quadrilateral panels is oblique.

11. The building structure as recited in claim 8 wherein the third edges of said first and second quadrilateral panels form edges of a first triangular opening.

12. The building structure as recited in claim 11 further comprising a structural element closing the first triangular opening.

13. The building structure as recited in claim 12 wherein the structural element includes a window.

14. The building structure as recited in claim 12 wherein the structural element includes a door.

15. The building structure as recited in claim 12 wherein the structural element is formed of flexible material which has an opening with a closure mechanism for egress and ingress.

16. The building structure as recited in claim 11 wherein the third edges of said third and fourth quadrilateral panels form edges of a second triangular opening.

17. The building structure as recited in claim 16 further comprising a first structural element closing the first triangular opening and a second structural element closing the second triangular opening.

18. The building structure as recited in claim 8 wherein:

the second edge of the first quadrilateral panel is attached by a first flexible connector to the second edge of the second quadrilateral panel;

the first edge of the second quadrilateral panel is attached by a first flexible connector to the first edge of the third quadrilateral panel;

the second edge of the third quadrilateral panel is attached by a first flexible connector to the second edge of the fourth quadrilateral panel; and the first edge of the fourth quadrilateral panel is attached by a first flexible connector to the first edge of the first quadrilateral panel.

* * * * *